United States Patent [19]

Robinson

[11] 4,036,404

[45] July 19, 1977

[54] MEANS FOR INDICATING DISHWASHER ADDITIVE ABSENCE

[75] Inventor: James D. Robinson, Memphis, Tenn.

[73] Assignee: Auto-Chlor System, Memphis, Tenn.

[21] Appl. No.: 684,006

[22] Filed: May 7, 1976

[51] Int. Cl.[2] ..... B67D 5/32; B67D 5/14

[52] U.S. Cl. ..... 222/39; 222/66

[58] Field of Search ..... 222/66, 23, 39, 63; 417/43, 44

[56] References Cited

U.S. PATENT DOCUMENTS

| | | | |
|---|---|---|---|
| 2,692,558 | 10/1954 | Garrett | 417/44 |
| 2,765,743 | 10/1956 | Hollinshead | 417/44 |
| 2,767,277 | 10/1956 | Wirth | 417/43 X |
| 2,952,209 | 9/1960 | Scholin | 222/66 X |
| 3,351,238 | 11/1967 | Gilbertson | 222/66 X |

*Primary Examiner*—Stanley H. Tollberg
*Assistant Examiner*—H. S. Lane
*Attorney, Agent, or Firm*—Littlepage, Quaintance, Murphy, Richardson & Webner

[57] ABSTRACT

A visual or audible indicator to indicate the absence of an additive ordinarily added to the rinse or wash water of a commercial dishwashing machine is disclosed. The dishwashing machine includes a separate reservoir containing an additive, a supply line connecting the reservoir to the point within the dishwashing machine where the additive is normally added, and a pump in the supply line for pumping the additive from the reservoir through the supply line. The pump includes a check-valve for retaining the additive in the supply line when the pump is not pumping. The indicator includes a vacuum operated switch and a connecting line connecting the vacuum operated switch to the supply line between the additive reservoir and the pump. The pump, switch, and connecting line are physically located above the maximum possible level of additive within the additive reservoir. The vacuum operated switch is adjusted such that the weight of the additive in the supply line between the connecting line and the reservoir is sufficient, when present, to create the vacuum necessary to operate the switch. The indicator is specifically designed so as to be easily added to preexisting commercial dishwashing machines with the minimum of alteration to the preexisting equipment.

6 Claims, 3 Drawing Figures

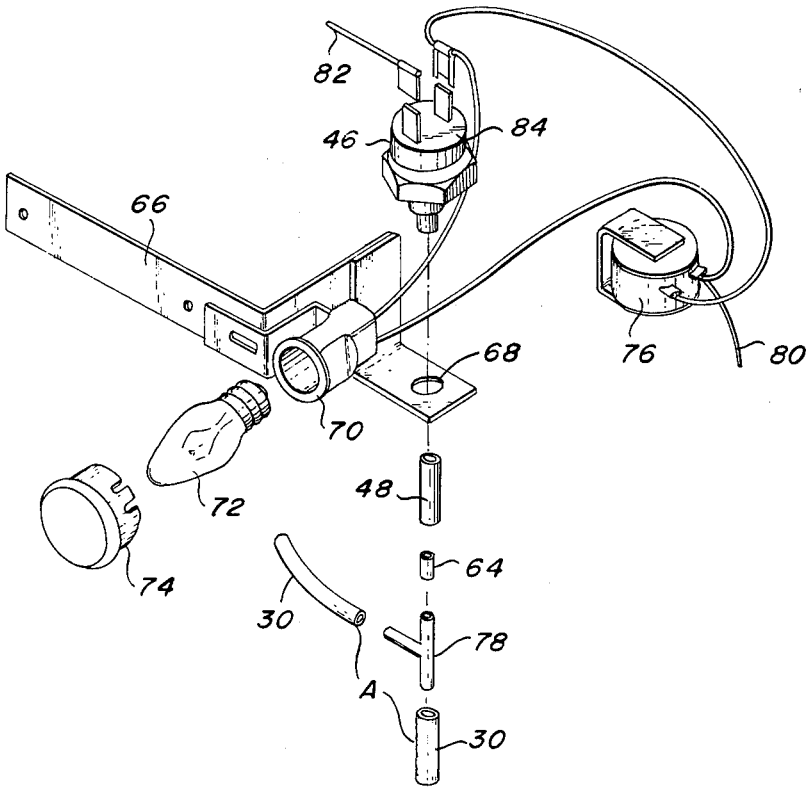
Fig. 2
Fig. 3
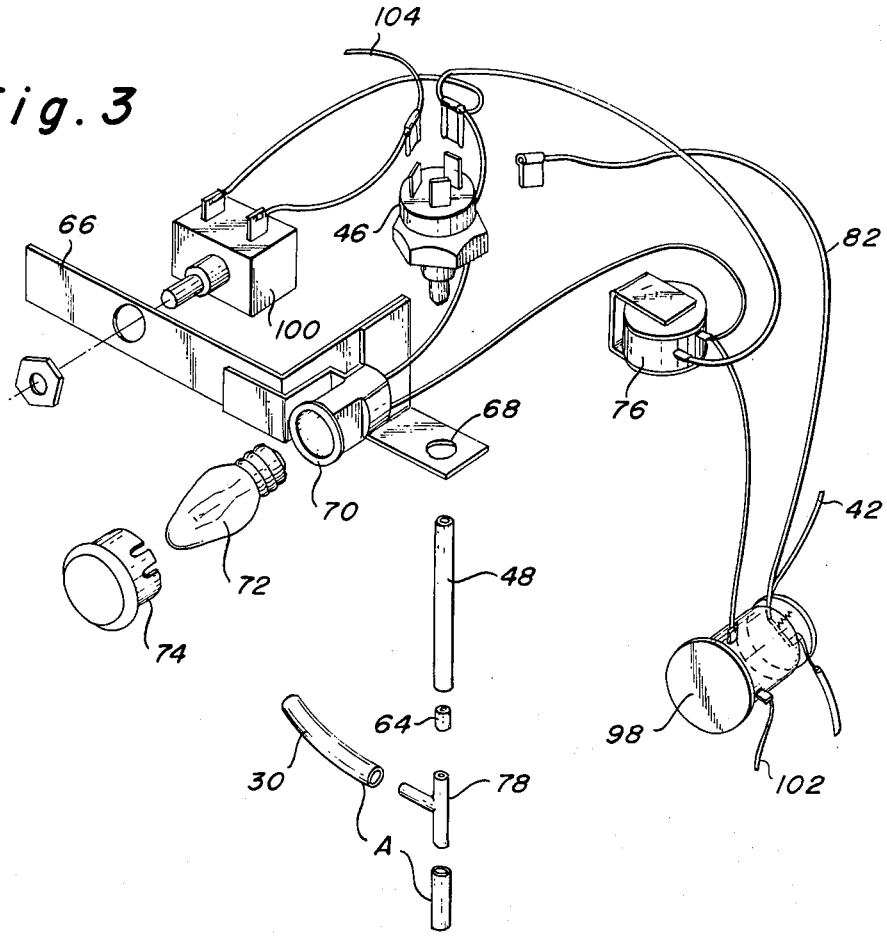

MEANS FOR INDICATING DISHWASHER ADDITIVE ABSENCE

BACKGROUND OF THE INVENTION

1. Field of the Invention

This invention pertains generally to devices for cleaning and liquid contact with solids having alarm, signal, indicating, testing, inspecting, illuminating or display means to be found in U.S. Patent Office Class 134, subclass 113. The invention particularly relates to an apparatus easily adapted to preexisting commercial dishwashing machines for indicating visually and/or audibly the absence of an additive within the supply line leading from the separate additive reservoir to the point within the dishwashing machine where the additive is normally added. The additives contemplated include all liquid alkaline and bleaching additives as well as low-foaming wetting agents and other commercial surfactants having general utility in the prewash, washing, or rinsing cycles of commercial dishwashing machines.

2. Description of the Prior Art.

Conventional commercial dishwashing machines now known to the trade and used in restaurants, hotels, hospitals, and other such institutions typically include a wash water tank or sump which contains a quantity of water and detergent in solution for cleansing the dishes and cutlery placed within the apparatus. Such dishwashing machines normally include means for moving trays of racks of dishes and cutlery through an enclosed housing where they are exposed to jets or sprays of liquids of predetermined temperature and chemical makeup so as to achieve maximum cleansing efficiency with minimum time and waste of natural resources. The addition of additives such as detergents, water softeners, water tension control agents and the like is typically controlled by a central control means controlling individual pumps connected by way of supply lines to reservoirs containing the particular additives intended for a particular purpose. Examples of dishwashing machines of this type are to be found in U.S. Pat. Nos. 3,139,890, 3,319,637, 3,680,784, 3,844,299, and 3,903,909.

The additives contained within the additive reservoirs are usually in concentrated form and must be appropriately diluted with water for the most economical use. In most circumstances a predetermined quantity of an additive is injected by an appropriate pumping means into a line or tank within the dishwashing apparatus. In certain circumstances the addition of the additive is controlled by electrodes which are adapted to sense the concentration of the particular additive in the tank or line in question. In either circumstance, if the content of the reservoir containing the particular additive has been depleted or if the supply line supplying the additive has ruptured there has heretofore been no practical way for indicating this condition to the machine operator.

It has been suggested that the simplest means for monitoring the presence or absence of an additive within the reservoir is to form the reservoirs of a transparent material which is easily visibly checked periodically by the machine operator. In larger installations, however, the reservoirs take the form of standard 15, 30 or 55 gallon steel drums. This renders the visible inspection to determine the level of the contents extremely difficult if not impossible. In such circumstances the prior art has suggested placing wands within each reservoir, each wand containing an electric switch at the lower end thereof sensitive to the presence or absence of the additive by the weight or pressure of the liquid surrounding the switch at the end of the wand. The switch is then appropriately associated with a signal means and a convenient source of power for operating the signal means. While such an indicating means would signal the presence or absence of the additive within the additive reservoir, it would not assure that the additive was actually being delivered by the particular pumping means associated with that additive. Further, it required the careful and delicate repositioning of the wand within the reservoir each time the reservoir was changed when the prior existing contents was depleted. Finally, it was felt that this represented an unnecessarily complicated solution to the problem presented.

Thus, a practical solution was sought to this problem which would immediately indicate the absence of an additive within the delivery line normally delivering that additive to the dishwashing machine and which was consistent with the reliability of commercial equipment performance and inexpensive to install. It was desired that the indicating means could be applied to existing commercial equipment and thereafter require no further handling for its proper operation thus resulting in greatly improved efficiency and reliability. It was also desired that the indicating means would not actually contact the additive in question thus reducing significantly any corrosion problems inherent with the sensing of the presence or absence of the liquids in question. Each of these features and advantages are to be found in the indicating means according to this invention.

SUMMARY OF THE INVENTION

A means for indicating the presence or absence of a liquid additive according to this invention is used in combination with the dishwashing machine comprising a reservoir for containing an additive, a supply line connecting the reservoir to a point within the machine wherein the additive is normally added, and a pumping means in the supply line for pumping the additive from the reservoir through the supply line. The pumping means can be any appropriate delivery device capable of moving a liquid through a tube, conduit, or the like. The pumping means include a check-valve means for retaining the additive in the supply line when the pumping means is not pumping. The indicating means comprises a vacuum operated switch and a connecting line connecting the vacuum operated switch to the supply line between the reservoir and the pumping means. The pumping means, switch and connecting line are physically located above the maximum possible level of additive in the reservoir. The vacuum operated switch is adjusted such that the weight of the additive in the supply line between the connecting line and the reservoir is sufficient, when present, to create the vacuum necessary to operate the switch.

The switch can comprise a single pair of normally closed contacts held open by the vacuum caused by the presence of the additive in the supply line between the connecting line and the reservoir. In this embodiment the contacts are in series with an alarm means for signalling an alarm and an appropriate source of power for operating the alarm means in the event the contacts should close due to the absence of additive in the supply line.

In another embodiment the switch can comprise at least a single pair of normally open contacts held closed by vacuum caused by the presence of the additive in the supply line between the connecting line and the reservoir. In this embodiment the contacts are in series with the pumping means and a control means for controlling the pumping means whereby the pumping means is prevented from operating in the event the contacts should open due to the absence of additive in the supply line.

In yet another embodiment the vacuum operated switch comprises a single pole double throw switch wherein a first pair of contacts are held opened and a second pair of contacts are held closed by the vacuum caused by the presence of the additive in the supply line between the connecting line and the reservoir. The first pair of contacts are in series with an alarm means for signalling an alarm and an appropriate source of power for operating the alarm means. The second pair of contacts are in series with the pumping means and the control means for controlling the pumping means. In the event that the additive is no longer present in the supply line, the first pair of contacts close and the second pair of contacts open thus the pumping means will be prevented from operation and the alarm means will signal an alarm.

The vacuum operated switch comprises generally a chamber opening only to the connecting line connecting the vacuum switch to the supply line between the reservoir and the pumping means. One wall of the chamber defines a diaphragm moveable with respect to the remaining portion of the chamber. A biasing means is present for biasing the position of the diaphragm to a preselected position and the biasing means can be adjusted by a bias adjusting means. The adjusting means is adjusted such that the weight of the additive in the supply line between the connecting line and the reservoir is sufficient, when present, to create a vacuum within the chamber sufficient to operate the switch against the biasing means. Improved reliability of performance of the vacuum switch can be achieved by further placing a restrictive orifice in the connecting line between the vaccum switch and the supply line for preventing any momentary false action of the vacuum operated switch during startup of the pumping means. Further, improved sensitivity of the vacuum operated switch can be achieved where the biasing means comprises a first and second biasing means on opposite sides of the diaphragm within the vaccum operated switch.

In the further embodiment of the invention the first pair of contacts which are normally closed but are held open by the vacuum caused by the presence of additive in the supply line between the connecting line and the reservoir are also connected in series with the power coil of an electrical relay and an appropriate source of power for energizing the relay power coil in the event the first pair of contacts should close due to the absence of additive in the supply line. The electrical relay has a single pair of normally closed contacts connected in series with the main power source for the dishwashing machine such that energizing of the relay power coil will open the single pair of normally closed contacts thus removing electrical power from all elements of the dishwashing machine except the alarm means. A normally open single pole switch can also be included as a reset or restart switch to initiate normal dishwashing machine function after an extended supply of additive has been renewed. Further features of the invention will become apparent upon consideration of the following description of the embodiments illustrated in the accompanying figures.

BRIEF DESCRIPTION OF THE DRAWINGS

FIG. 2 is a perspective view partially exploded of an indicator warning system according to this invention adapted for use with an already existing dishwashing apparatus.

FIG. 3 is a perspective view partially exploded of another embodiment of a warning or indicating system according to this invention.

DESCRIPTION OF PREFERRED EMBODIMENTS

Figure 1:
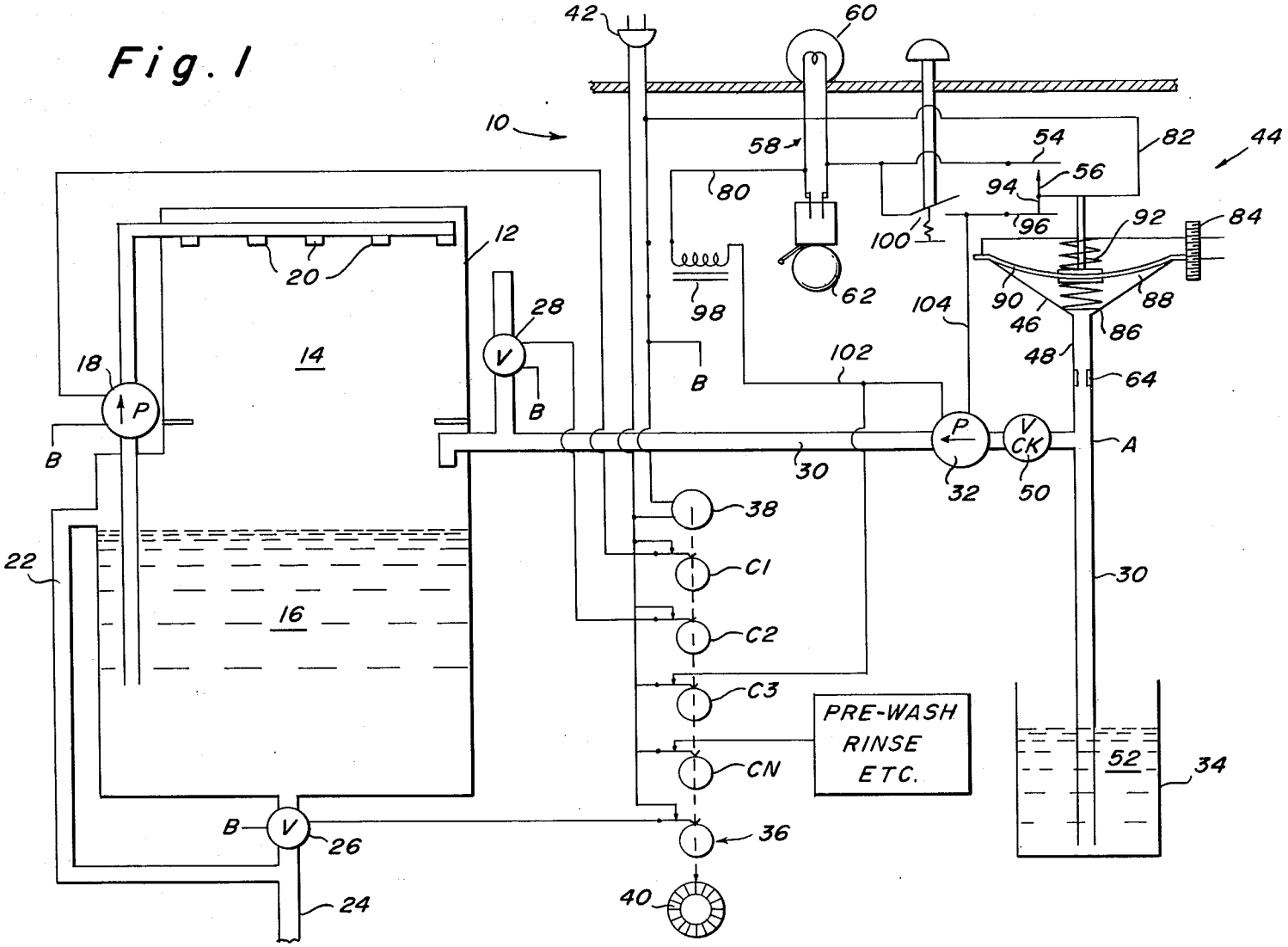
FIG. 1 is a diagrammatic illustration of a dishwashing machine incorporating an indicating means according to this invention.

FIG. 1 diagramatically illustrates a typical dishwashing machine 10 incorporating the several features of this invention. The dishwashing machine is illustrated to have an enclosure 12 through which the dishes and cutlery to be washed are transported. For the purpose of illustration of FIG. 1, it will be assumed that the dishes move through the enclosure 12 along a line perpendicular to the plane containing the figure, the dishes periodically occupying space 14 above wash water sump 16. Wash water is pumped by pump 18 from sump 16 to sprayheads 20 thus cleansing dishes occupying space 14. The level of the wash water within sump 16 is controlled by overflow pipe 22 leading to drain 24. All of the water can be removed from sump 16 by opening valve 26 also leading to drain 24. The wash water within sump 16 is originally supplied from an external source through valve 28. Additional quantities of water are usually periodically added to sump 16 when the dishes are rinsed with dish water from sprayheads not shown.

Predetermined quantities of additives are added through a supply line 30 by pumping means 32 from a separate reservoir 34. The operation of the dishwashing machine is controlled by a control means 36 which is illustrated to include a timer motor with slip clutch 38 driving a series of cams C1, C2 etc., which may be initially positioned by dial 40 conveniently positioned for the machine operators use. The dishwashing machine is powered from an external source of power through power line 42 in a conventional manner.

The dishwasher illustrated and described heretofore is exemplary only and is not to be regarded as limiting the use of the invention. Rather the invention previously summarized may be used in combination with any known washing or cleansing machinery in which it is desired to periodically inject one or more liquid compounds as additives to enhance the operable function of the machine. In particular, the control means 36 may well be a control circuit of the type disclosed in U.S. Pat. No. 3,844,299 rather than that illustrated. While the following discussion is limited to a single subsystem comprising the supply line 30, pumping means 32, and reservoir 34, it is assumed that a plurality of similar subsystems may exist within a single dishwashing apparatus as illustrated in U.S. Pat. Nos. 3,319,637 and 3,903,909.

An indicating or warning means according to this invention is illustrated generally in FIG. 1 as 44 and comprises generally a vacuum operated switch 46 and a connecting line 48 connecting the vacuum operated switch 46 to the supply line 30 between the reservoir 34 and the pumping means 32. The pumping means 32 generally includes a check-valve means 50 for retaining the additive 52 in the supply line 30 when the pumping means 32 is not pumping. The check-valve means 50 may simply exist as a feature of the pumping means 32 which permits the pumping means 32 to retain the liquid additive 52 in that portion of supply line 30 found between the reservoir 34 and the pumping means 32. The pumping means 32, switch 46, and connecting line 48 are physically located above the maximum possible level of the additive 52 in the reservoir 34. The vacuum operated switch 46 is selected or adjusted such that the weight of the additive 52 within the supply line 30 between the connecting line 48 and the reservoir 34 is sufficient, when present, to create the vacuum necessary to operate the switch 46. Since the switch 46 is separated from the supply line 30 by the connecting line 48, there is very little opportunity for the switch 46 to come in direct contact with the additive 52 thus significantly reducing any corrosion problem which might otherwise be experienced. The vacuum operated switch 46 further comprises at least a single pair of normally closed contacts 54 and 56 which are held open by the vacuum caused by the presence of additive 52 in the supply line 30 between the connecting line 48 and the reservoir 34. The contacts 54 and 56 are connected in series with an alarm means 58 for signalling an alarm and an appropriate source of power for operating the alarm means 58 in the event the contacts 54 and 56 should close due to the absence of additive 52 in the supply line 30. The alarm means 58 preferably comprises both a visual alarm 60 and an audible alarm 62. A restrictive orifice 64 is placed in the supply line 48 to prevent any momentary false actuation of the vacuum switch 46.

To illustrate how easily a warning system of this type is adapted to existing dishwashing machines, consider FIG. 2 which shows vacuum switch 46 exploded vertically away from but adapted to be retained in bracket 66 through mounting hole 68. Also mounted to bracket 66 is socket 70 adapted to receive bulb 72 which is in turn covered by light cover 74. A buzzer 76 is wired in parallel with the socket 70. A short connecting line 48 having restrictive orifice 64 positioned within it is attached to the switch 46 and to T-connector 78.

To install the warning system illustrated in FIG. 2 one need only sever supply line 30 at point A which is somewhere between pumping means 32 and reservoir 34. The two severed portions of supply line 30 are then attached to the T connector 78. Wires 80 and 82 are then attached to any appropriate source of power for operating the buzzer and light. The vacuum operated switch 46 can be selected to have the proper operating characteristics such that the weight of the additive in the supply line 30 between the connecting line 48 and the reservoir 34 is sufficient, when present, to create the vacuum necessary to operate the switch 46. Practically, the selection of a different switch for each different installation is not feasible and therefore the vacuum switch 46 preferably includes a means 84 for adjusting the functionally operative point of the vacuum switch 46 so as to assure proper operation in a multitude of different installations.

In FIG. 1 the adjusting means 84 is illustrated as a threaded screw which adjusts the tension of biasing means 86 within switch 46. Other details of the vacuum operated switch 46 include a chamber 88 opening only to the connecting line 48, one wall of the chamber defining a diaphragm 90 moveable within the remaining portions of the chamber 88. A second biasing means 92 is located on an opposite side of the diaphragm 90 from the first biasing means 86, the pair of biasing means functioning to increase the sensitivity of the vacuum operated switch.

While the dispenser warning system according to this invention need not include anything other than that illustrated in FIG. 2, in a second preferred embodiment the switch 46 further comprises a second pair of normally open contacts 94 and 96 which are held closed by the vacuum caused by the presence of additive 52 in the supply line 30 between the connecting line 48 and the reservoir 34. In this embodiment the contacts 94 and 96 are connected in series with the pumping means 32 and the control means 36 such that the pumping means 32 is prevented from operating in the event the contacts 94 and 96 should open due to the absence of additive 52 in supply line 30. In the preferred embodiment illustrated in FIG. 1, contact 94 and contact 56 are the same contact and in this arrangement the absence of additive 52 in supply line 30 will cause the pumping means 32 to cease pumping and will sound the alarm. Note that the switch associated with cam C3 controls the operation of pumping means 32. At an appropriate time during the duty cycle of the dishwashing machine 10, the switch associated with cam C3 will close causing pumping means 32 to be actuated. The presence of the additive 52 in supply line 30 will retain the contacts of switch 46 in the position illustrated in FIG. 1. On the other hand, the absence of the additive 52 in supply line 30, either due to the exhaustion of the additive 52 in the reservoir 34 or due to a leak in supply line 30 somewhere between the pumping means 32 and reservoir 34, will cause contacts 94 and 96 to open and cause contacts 54 and 56 to close thereby stopping the pumping means 32 and actuating the alarm means 58.

As illustrated in FIG. 1, the alarm circuit also includes a relay 98. The contacts of relay 98 are shown to be wired into one portion of the main power line 42 of the dishwashing apparatus 10 such that energizing of the relay 98 opens the single pair of normally closed contacts thus removing electrical power from all elements of the dishwashing machine 10 except the alarm means 58 and relay 98. In this fashion the absence of an additive within supply line 30 is immediately sensed upon actuation of the pumping means 32 which in turn stops the dishwashing machine at the exact position in its duty cycle and signals an alarm. The operator of the machine would then presumably replenish the additive 52 within reservoir 34 and then be faced with reinitiating the action of the dishwashing apparatus. To reinitiate the action of the dishwashing apparatus a restart switch 100 is included which is biased in the normally open position. Recalling that when the alarm means 58 is operating contacts 54 and 56 are closed due to the absence of the necessary vacuum in the vacuum switch 46, the momentary closing of switch 100 again connects pumping means 32 with an appropriate source of power for operating the pumping means. The pumping action of the pumping means 32 when continued for even a short period of time will create the necessary vacuum to open contacts 54 and 56 and close contacts 94 and 96 thus restoring the dishwashing machine 10 to its normally operating duty cycle the moment that the temporarily closed restart switch 100 is released.

The hardware for creating this second preferred embodiment is illustrated in FIG. 3 in which those portions of the circuit which remain unchanged from FIG. 2 have been given the same identifying numerals. Note that wire 82 now connects directly with the main power line 42 before that power line is attached to the contacts of relay 98. The vacuum operated switch 46 illustrated in FIG. 3 is a single pole double throw switch as schematically indicated in FIG. 1. The pushbutton restart switch 100 is physically placed in the immediate proximity of the indicating light so as to be easily accessible by the dishwashing machine operator. Wire 102 is connected between the control means 36 and the pumping means 32 while wire 104 is connected between the pumping means 32 and the vacuum operated switch 46. The connecting line 48 is attached to the supply line 30 in a manner analogous to that discussed in conjunction with FIG. 2.

The ease of installation of the devices illustrated in FIGS. 2 and 3 into already existing equipment to provide a means for indicating the absence of a dishwasher additive in a supply line normally handling additive commends this apparatus for widespread use. While the invention has been described in considerable detail with reference to certain preferred embodiments thereof, it will be understood that variations and modifications can be effected within the spirit and scope of the invention as described above and as defined in the appended claims.

What is claimed is:

1. In a dishwashing machine comprising a reservoir for containing an additive, a supply line connecting the reservoir to a point within the dishwashing machine where the additive is normally added, a pumping means in the supply line for pumping the additive from the reservoir to said point, the pumping means including a check-valve means for retaining the additive in the supply line when the pumping means is not pumping, and control means for controlling the pumping means, the improvement which comprises:

a vacuum operated switch and a connecting line connecting the vacuum operated switch to the supply line between the reservoir and the pumping means, the pumping means, switch and connecting line being physically located above the maximum possible level of additive in the reservoir, the vacuum operated switch comprising at least one pair of electrical contacts, a chamber opening only to the connecting line, one wall of the chamber defining a diaphragm moveable with respect to the remaining portion of the chamber, biasing means for biasing the position of the diaphragm to a preselected position, adjusting means for adjusting the biasing means and connector means for connecting the diaphragm to a moveable portion of the at least one pair of electrical contacts, the adjusting means being adjusted such that the weight of the additive in the supply line between the connecting line and the reservoir is sufficient, when present, to create a vacuum within the chamber sufficient to operate the switch against the biasing means.

2. The improvement in claim 1 wherein the connecting line connecting the vacuum operated switch to the supply line further comprises a restricted orifice for preventing a momentary false action of the vacuum operated switch.

3. The improvement of claim 1 wherein the biasing means further comprises a first and second biasing means on opposite sides of the diaphragm for increasing the sensitivity of the vacuum operated switch.

4. The improvement of claim 1 wherein the at least one pair of electrical contacts comprises a first pair of contacts and wherein the adjusting means is adjusted such that the first pair of contacts are normally closed but held open by the vacuum caused by the presence of additive in the supply line between the connecting line and the reservoir, the first pair of contacts being in series with an alarm means for signalling an alarm and an appropriate source of power for operating the alarm means in the event the first pair of contacts should close due to the absence of additive in the supply line.

5. The improvement of claim 4 wherein said at least one pair of electrical contacts further comprises a second pair of contacts which, when the adjusting means is adjusted as specified in claim 4, are normally open but are held closed by the vacuum caused by the presence of additive in the supply line between the connecting means and the reservoir, the second pair of contacts being in series with said pump means and said control means for preventing operation of the pump means in the event the second pair of contacts should open due to the absence of additive in the supply line.

6. The improvement of claim 4 wherein said first pair of contacts are also connected in series with the power coil of an electrical relay and an appropriate source of power to energize the relay power coil in the event the first pair of contacts should close due to the absence of additive in the supply line, the electrical relay having a single pair of normally closed contacts connected in series with the main source of power for said dishwashing machine such that energizing of the relay power coil will open the single pair of normally closed contacts thus removing electrical power from all elements of said dishwashing machine except said alarm means.

* * * * *